United States Patent [19]

Shioda

[11] Patent Number: 4,746,236

[45] Date of Patent: May 24, 1988

[54] PRINTER WITH A MOTOR CONTROLLED BY CHOPPING MEANS

[75] Inventor: Junji Shioda, Nagoya, Japan

[73] Assignee: Brother Kogyo Kabushiki Kaisha, Nagoya, Japan

[21] Appl. No.: 813,883

[22] Filed: Dec. 27, 1985

[30] Foreign Application Priority Data

Dec. 28, 1984 [JP] Japan ..... 59-275212

[51] Int. Cl.[4] ..... B41J 23/34

[52] U.S. Cl. ..... 400/187; 400/144.2; 400/214; 400/157.1

[58] Field of Search ..... 400/185, 187, 144.2, 400/568, 569, 636, 157.1, 697, 697.1, 214, 215, 225, 236; 363/124

[56] References Cited

U.S. PATENT DOCUMENTS

| | | | |
|---|---|---|---|
| 3,636,867 | 1/1972 | Bonzano | 101/93 |
| 3,663,880 | 5/1972 | Gabor | 318/603 |
| 3,760,925 | 9/1973 | Bossi . | |
| 3,825,103 | 7/1974 | Riley | 400/219.5 |
| 3,843,912 | 10/1974 | Anderson | 363/124 X |
| 3,972,280 | 8/1976 | Swatik et al. | 101/93.16 |
| 4,338,035 | 7/1982 | Kondo et al. | 400/187 X |
| 4,376,585 | 3/1983 | Fromme et al. | 400/185 |
| 4,395,149 | 7/1983 | Longrod | 400/697.1 X |
| 4,402,073 | 8/1983 | Hammond | 370/9 |
| 4,472,073 | 9/1984 | Valle et al. | 400/185 |
| 4,480,938 | 11/1984 | Polk et al. | 400/322 |
| 4,538,931 | 9/1985 | Nagashima | 400/157.1 X |

FOREIGN PATENT DOCUMENTS 2043544 10/1980 United Kingdom .

*Primary Examiner*—Charles A. Pearson
*Attorney, Agent, or Firm*—Jones, Tullar & Cooper

[57] ABSTRACT

A printer in which a daisy wheel on a carriage is caused, by a hammer actuating mechanism, to impact against a printing sheet fed by a sheet feed mechanism, so that the sheet is printed with use of a ribbon interposed between the sheet and the wheel. The hammer actuating mechanism, a printing ribbon feed mechanism, a correction ribbon feed mechanism, and a correction ribbon lift mechanism constituting a first driven section, and the sheet feed mechanism constituting a second driven section, are connected to a single DC motor by means of clutch means. In driving the first driven section, the motor is supplied with a predetermined supply voltage from an external power source. In driving the second driven section, the motor is supplied with a supply voltage chopped by chopping means so that the second driven section is driven with a smaller driving force and at a lower rotating speed than the first driven section is.

5 Claims, 11 Drawing Sheets

PRINTER WITH A MOTOR CONTROLLED BY CHOPPING MEANS

BACKGROUND OF THE INVENTION

The present invention relates to a printer provided with printing means, such as a daisy wheel, adapted to be opposed to a printing sheet or other printing medium to effect printing thereon.

In printers of this type, a plurality of mechanisms are used to perform various operations associated with a printing operation. Where the printing means of one such printer is formed of a daisy wheel, for example, these mechanisms include a hammer actuating mechanism which causes selected types on the wheel to impact against a printing medium on a platen. The mechanisms further include a ribbon feed mechanism for feeding a printing ribbon between the platen and printing means, and a sheet feed mechanism for feeding the printing medium line by line. In a printer having a function to correct printed characters, i.e., so-called correcting function, a correction ribbon feed mechanism is combined with a correction ribbon lift mechanism which serves to raise a correction ribbon from a normal or pause position to a printing position. These mechanisms are adapted to be actuated by a driving force supplied from drive source means. However, the driving characteristics, including rotational load and rotating speed, required for the operation of one mechanism are different from those for the operation of another.

In the prior art printers, therefore, a plurality of drive motors are used to operate the individual mechanisms. The mechanisms are divided into several groups by the driving characteristics, and a common motor is provided for each group.

In this case, however, so many motors are used in each printer that the manufacturing cost is very high, and the necessary space for the motors is too wide to provide a compact design.

Meanwhile, an arrangement has been proposed in which a single drive motor is coupled to the various mechanisms by means of reduction gear systems so that different rotating speeds are provided for the individual mechanisms as required.

However, the proposed arrangement requires complicated reduction gear systems, resulting in sophisticated printer construction, increase in number of components, and higher manufacturing cost. Moreover, an additional space is needed for the gear systems, constituting a hindrance to the miniaturization of the printer.

Conventional printers of the proposed arrangement are subject to a further drawback that the reduction gear mechanisms produce substantial noises during operation.

One such printer is disclosed in U.S. Pat. No. 3,825,103.

SUMMARY OF THE INVENTION

The object of the present invention is to provide a printer which is free from the aforementioned drawbacks of the prior art printers, and is constructed so that a single drive motor is used effectively to drive a plurality of mechanisms for various operations associated with a printing operation, thereby reducing the inside space of the printer for a compact design and lowering the manufacturing cost.

In order to achieve the above object, according to the present invention, a single DC motor is used to drive a plurality of mechanisms which are divided into groups. The groups include a first driven section and a second driven section which is lower in rotational load and rotating speed than the first one. In driving the first driven section, a predetermined supply voltage is supplied from an external power source to the DC motor to provide a predetermined driving force for the section. In driving the second driven section, on the other hand, the predetermined supply voltage is chopped by chopping means so that a suitable driving force is applied to the second driven section.

Thus, under the selective control of the chopping means, the single DC motor serves to drive the first and second driven sections which have different driving characteristics. Accordingly, the space for the motor arrangement is narrow, and there is no need of any reduction gear systems as are required by the prior art printers. In consequence, the inside space of the printer can be greatly reduced, facilitating a compact design and lowering the manufacturing cost.

In a preferred arrangement, the second driven section includes a printing medium feed mechanism having a platen which can rotate with a printing medium thereon. The first driven section includes a hammer actuating mechanism for actuating a printing hammer as printing means and a printing ribbon feed mechanism. The hammer actuating mechanism and the printing ribbon feed mechanism, which are operated with use of common clutch means, require a relatively heavy rotational load. Provided as a single mechanism, on the other hand, the printing medium feed mechanism requires only a lighter rotational load and a lower rotating speed than the aforesaid paired mechanisms do. These mechanisms may suitably be driven by the single DC motor whose supply voltage is selectively controlled by the chopping means according to the invention.

The first driven section further includes a correction ribbon feed mechanism and a correction ribbon lift mechanism, which are operated in association with each other also with use of common clutch means. Thus, the first driven section can enjoy a relatively heavy rotational load and a higher rotating speed, and can suitably be driven by the single DC motor of the invention without requiring any chopping control.

BRIEF DESCRIPTION OF THE DRAWINGS

These and other objects of the present invention will become more apparent and will be better understood with reference to the following detailed description taken in conjunction with the accompanying drawings, in which:

FIG. 13(*b*) is a time chart illustrating a voltage supply to the drive motor with chopping control.

DETAILED DESCRIPTION OF THE PREFERRED EMBODIMENT

A printer of a daisy-wheel type according to the present invention will now be described in detail with reference to the accompanying drawings.

Figure 2:
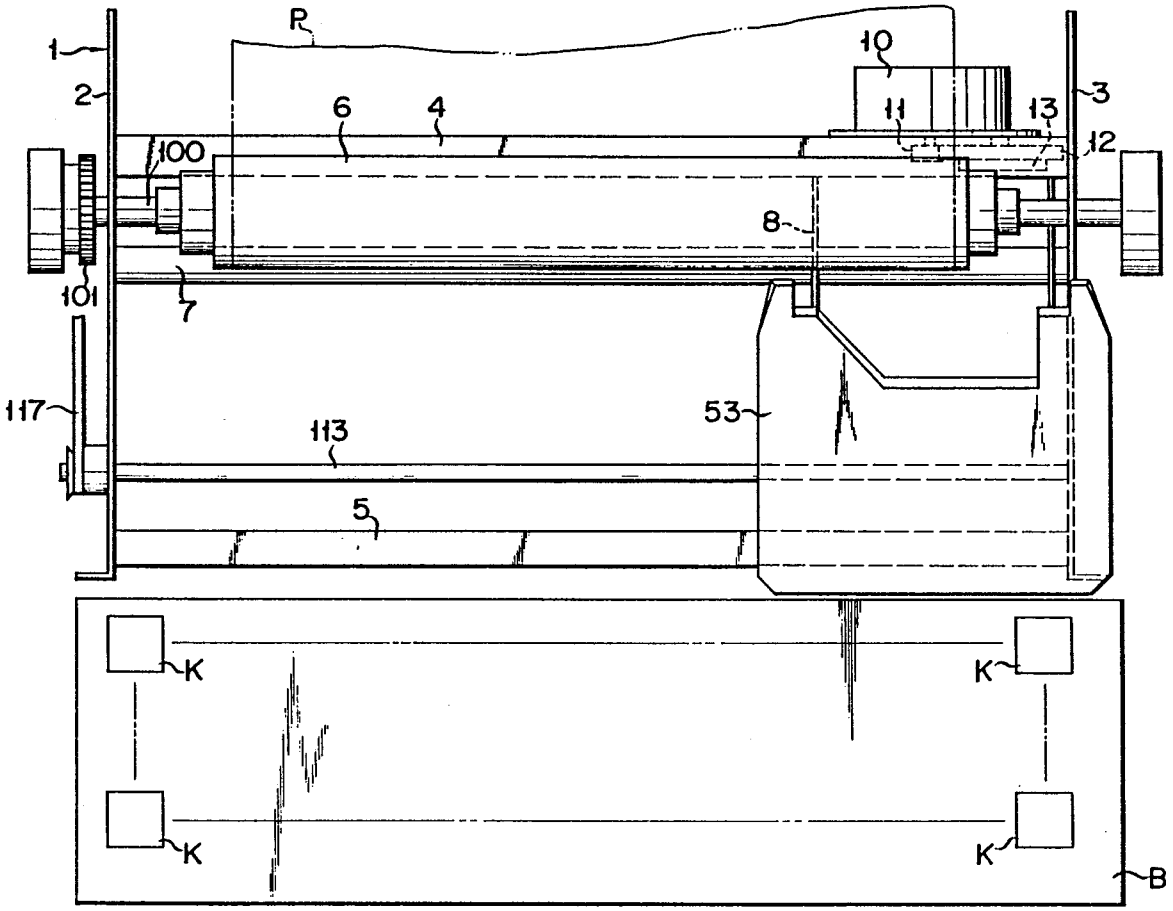
FIG. 2 is a schematic plan view of the printer of the invention with its cover removed.

As shown in FIG. 2, the printer comprises a keyboard B on which a number of keys K are arranged, at the front portion, and a cylindrical platen 6, at the rear portion, adapted to rotate and feed a printing sheet P as a printing medium wound thereon. In the drawings, the front and rear portions can be identified in the same relation throughout the several views.

Sheet Feed Mechanism

Figure 1:
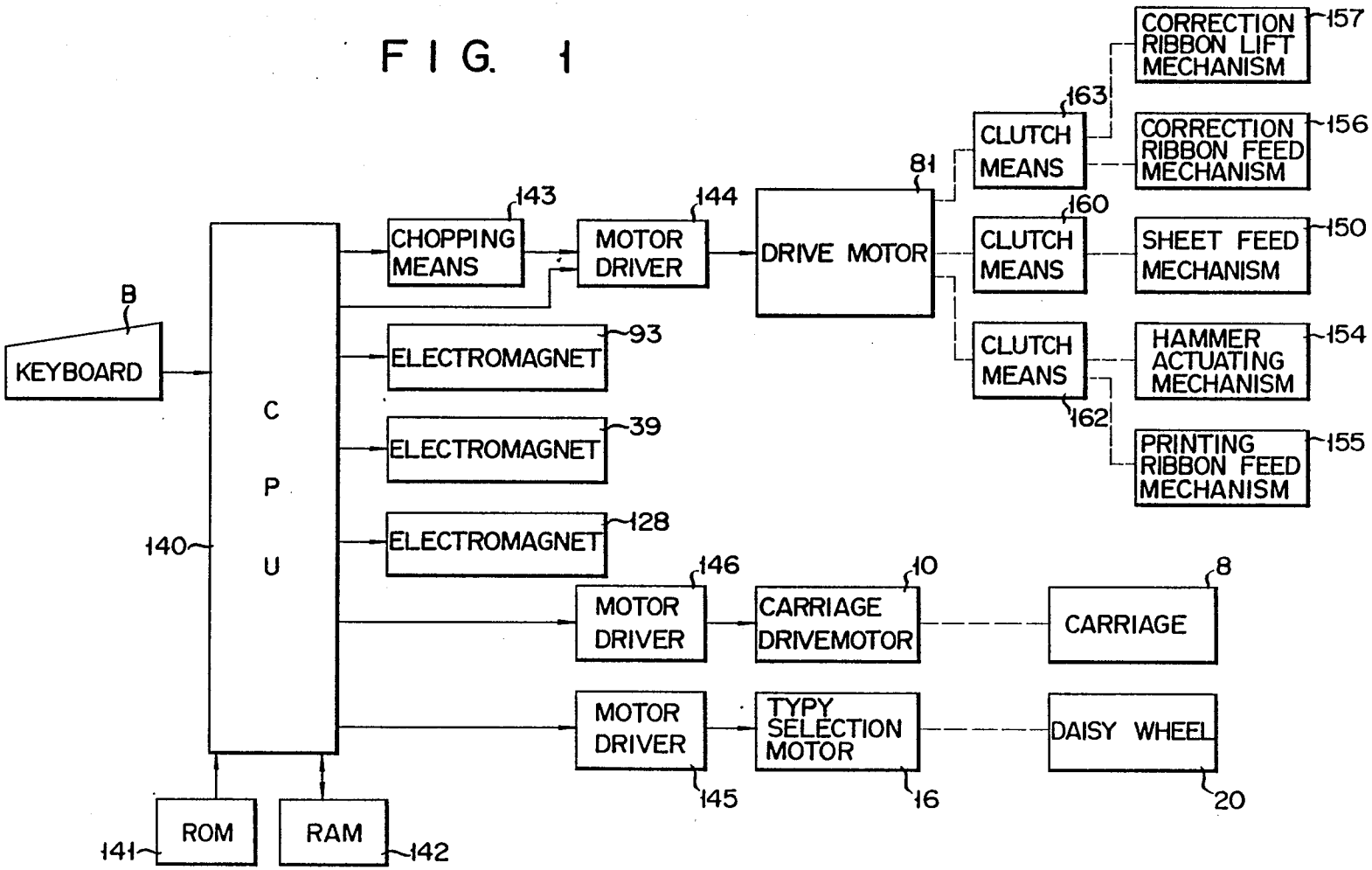
FIG. 1 is a block diagram for illustrating the operation control of a printer according to the present invention.
Figure 11:
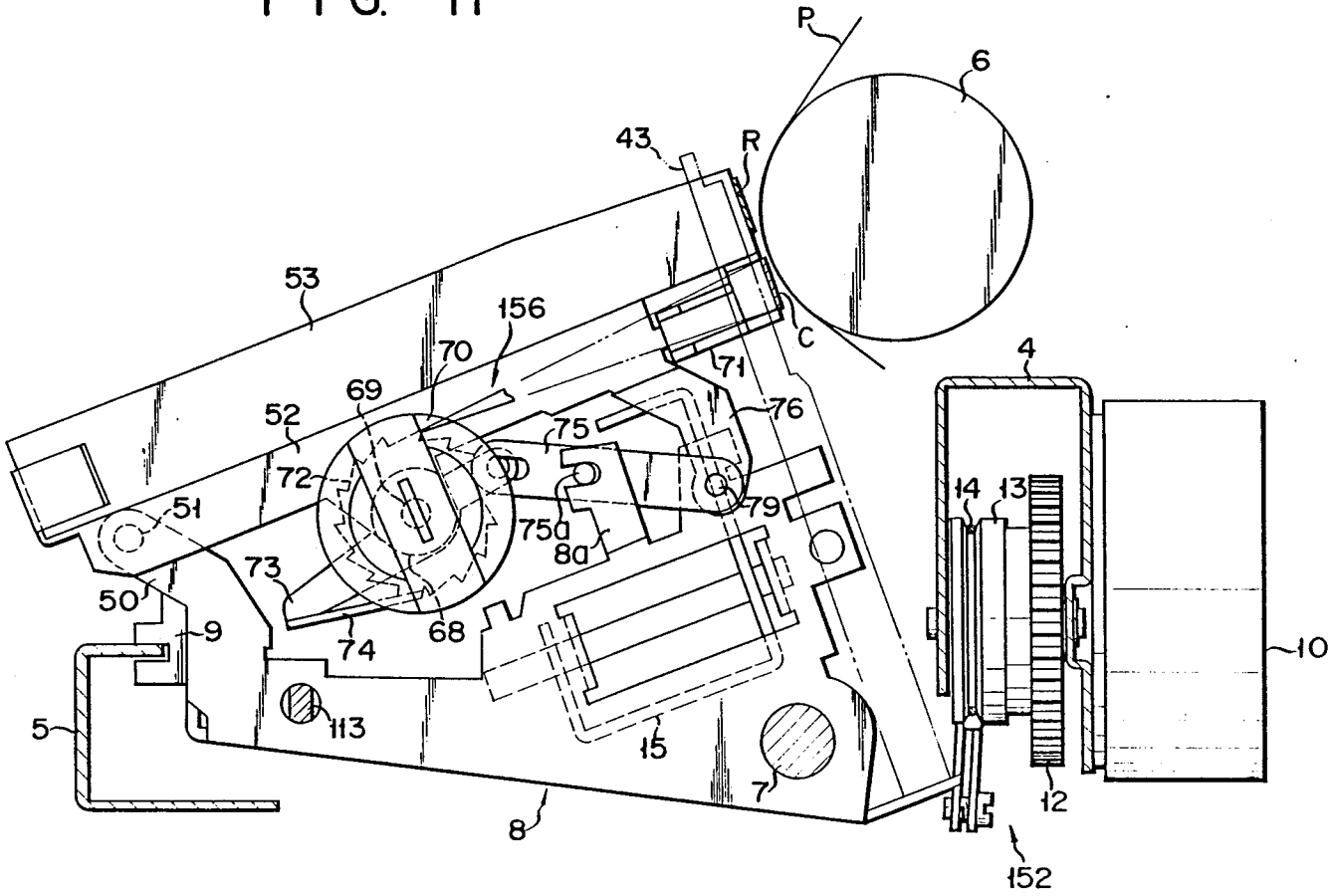
FIG. 11 is an enlarged side sectional view of the correction ribbon feed mechanism taken from the right-hand side of FIG. 2.

As shown in FIGS. 2 and 11, a pair of coupling frames 4 and 5, each having a substantially U-shaped cross section, are fixed between left and right side walls 2 and 3 of a printer frame 1. As shown in FIG. 2, the keyboard B is disposed in front of the front coupling frame 5. Overlying the rear coupling frame 4, the platen 6 is rotatably supported between both side walls 2 and 3. As the platen 6 is rotated with the printing sheet P thereon, the sheet P is fed along the surface of the platen 6 toward a print line which is defined on the front side of the platen 6. Described above is the principal part of a sheet feed mechanism 150 (FIG. 1). Several portions associated with clutch means 160, 162 and 163 (FIG. 1) will be described later.

Carriage Drive Mechanism

A carriage drive mechanism 152 is constructed as follows. A guide shaft 7 is anchored to the frame 1, extending parallel to the platen 6. A carriage 8 is supported, at its rear portion, on the guide shaft 7 so as to be slidable along the platen 6. The carriage 8 is formed of a bent metal plate. A guide piece 9 (FIGS. 3 and 11), which is attached to the front portion of the carriage 8, loosely engages the top portion of the front coupling frame 5 for sliding motion.

As shown in FIG. 2, a reversible stepping motor 10 for driving the carriage 8 is mounted on the right-hand side of the rear face of the rear coupling frame 4. Arranged inside the rear coupling frame 4, as shown in FIG. 11, is a driving pulley 13 which is rotated by the motor 10 through the medium of a driving gear 11 and a driven gear 12. A wire 14 (FIG. 3) is passed around the driving pulley 13 and a driven pulley (not shown) which is rotatably supported on the left-hand portion (FIG. 2) of the frame 1. Part of the wire 14 is fixed to the carriage 8. As the driving pulley 13 rotates, the carriage 8 reciprocates along the print line of the platen 6 with the aid of the driven pulley and the wire 14.

Type Selecting Mechanism

Figure 3:
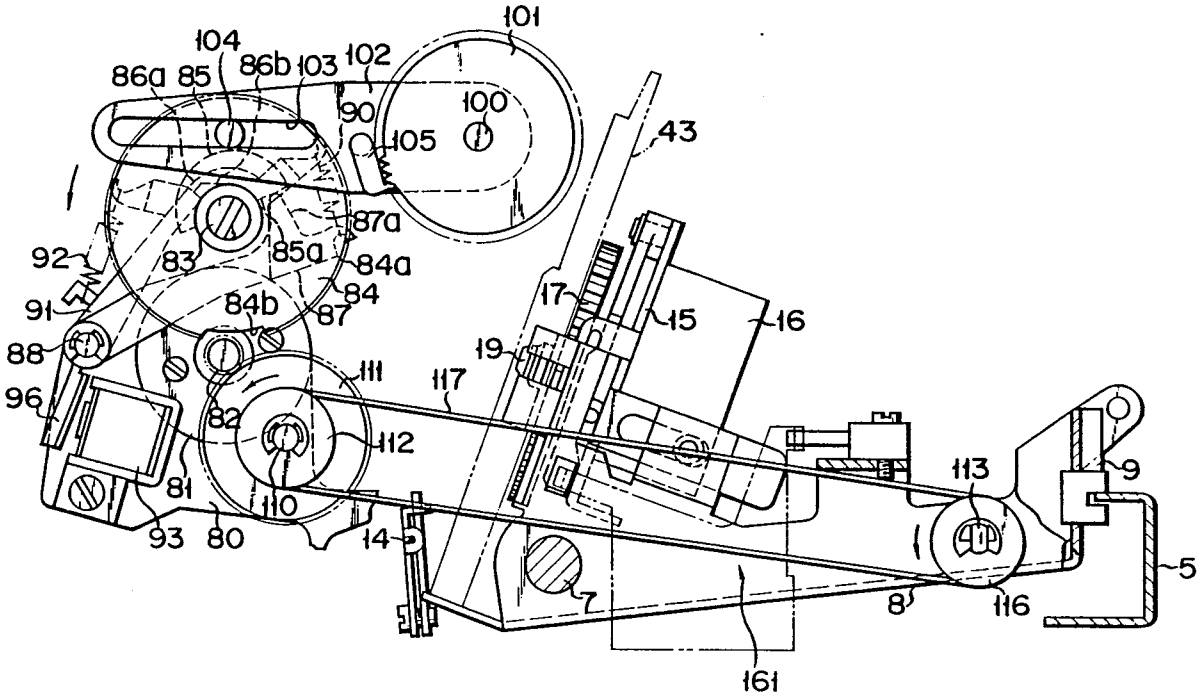
FIG. 3 is an enlarged side view of the principal part of the printer taken from the right-hand side of FIG. 2.
Figure 4:
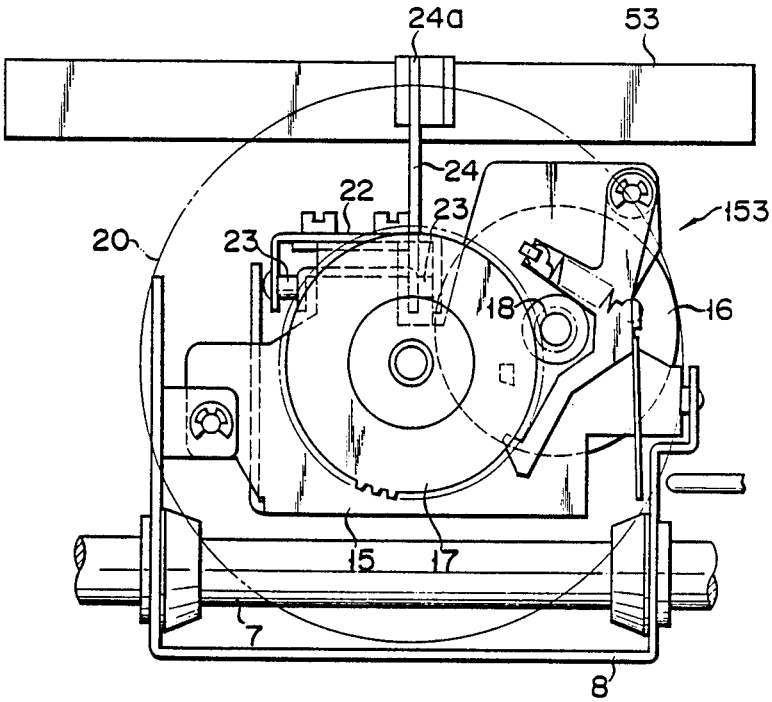
FIG. 4 is an enlarged rear view showing a carriage and its associated mechanisms.
Figure 6:
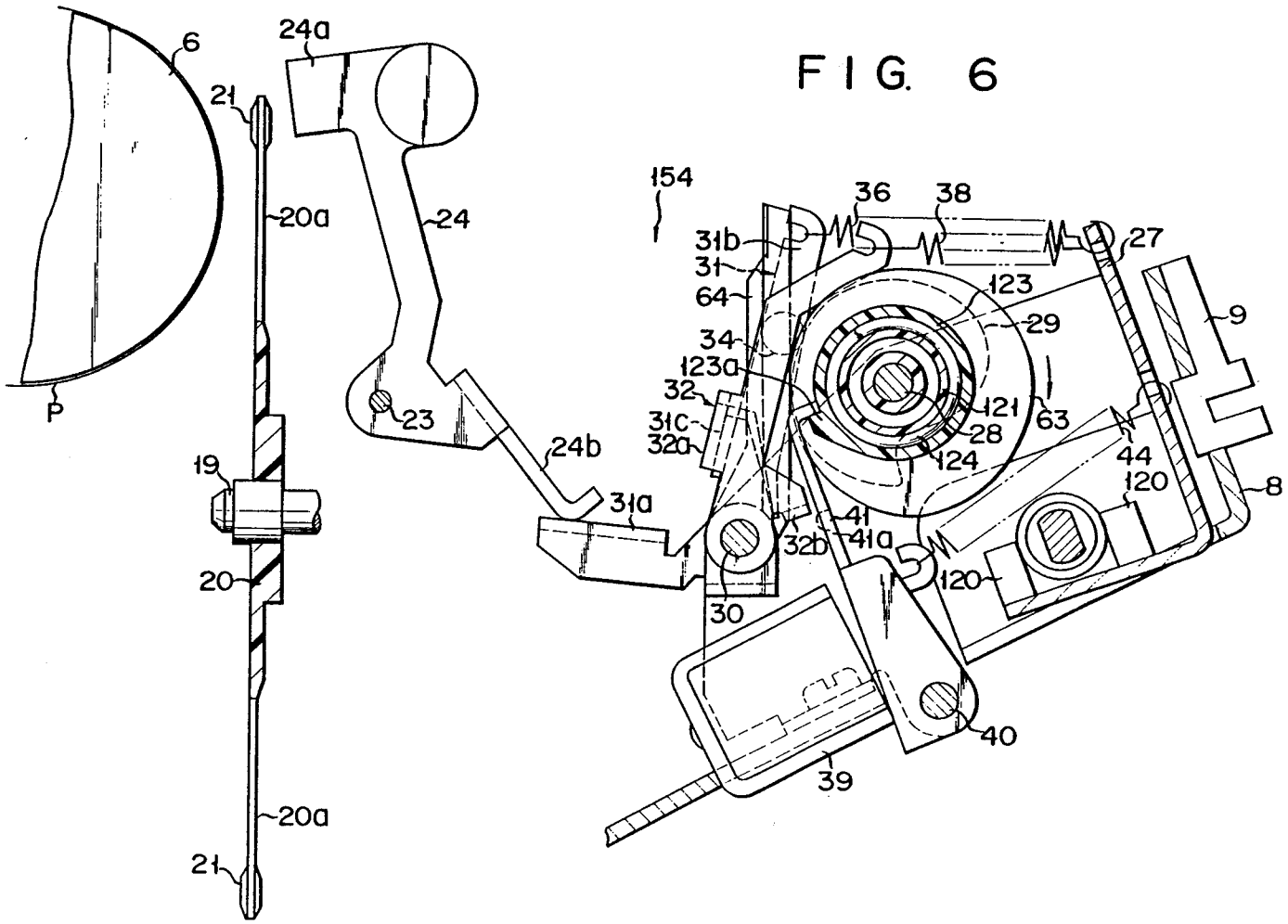
FIG. 6 is an enlarged side sectional view of a hammer actuating mechanism.

A type selecting mechanism 153 is constructed as follows. As shown in FIGS. 3 and 4, a stepping motor 16 for type selection is mounted on the front side of a motor bracket 15 which is supported by the rear portion of the carriage 8. A driven gear 17 is rotatably supported on the rear face of the motor bracket 15. Thus, when the motor 16 rotates, the driven gear 17 is rotated as it engages a driving gear 18 fixed on the shaft of the motor 16 which penetrates the motor bracket 15. A daisy wheel 20 having a number of radially extending type elements 20*a* is rotatably mounted on a shaft 19 which protrudes from the center of the rear face of the driven gear 17. As shown in FIG. 6, a type 21 is formed on the outer end of each type element 20*a*. If one of the character keys K on the keyboard B is depressed, the daisy wheel 20 is rotated to a predetermined rotational position in accordance with a print signal corresponding to the depressed key K. As a result, that type 21 of the type element 20*a* corresponding to the depressed key K is selectively located in a position facing the printing surface of the platen 6.

The daisy wheel 20 is housed in a casing 43 in the form of a flat box, and can be removably mounted, along with the casing 43, on the shaft 19. The construction of the casing 43 itself is conventional.

Hammer Actuating Mechanism

Figure 8:
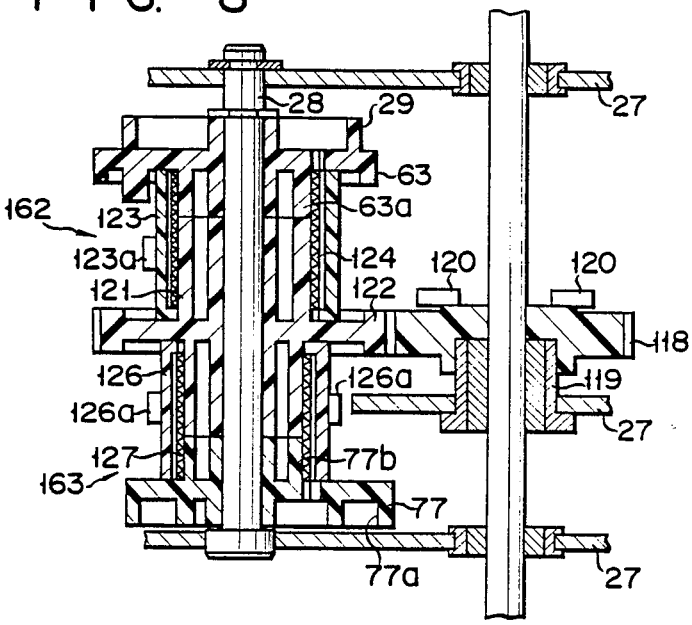
FIG. 8 is a sectional view showing an arrangement of clutch means.
Figure 7:
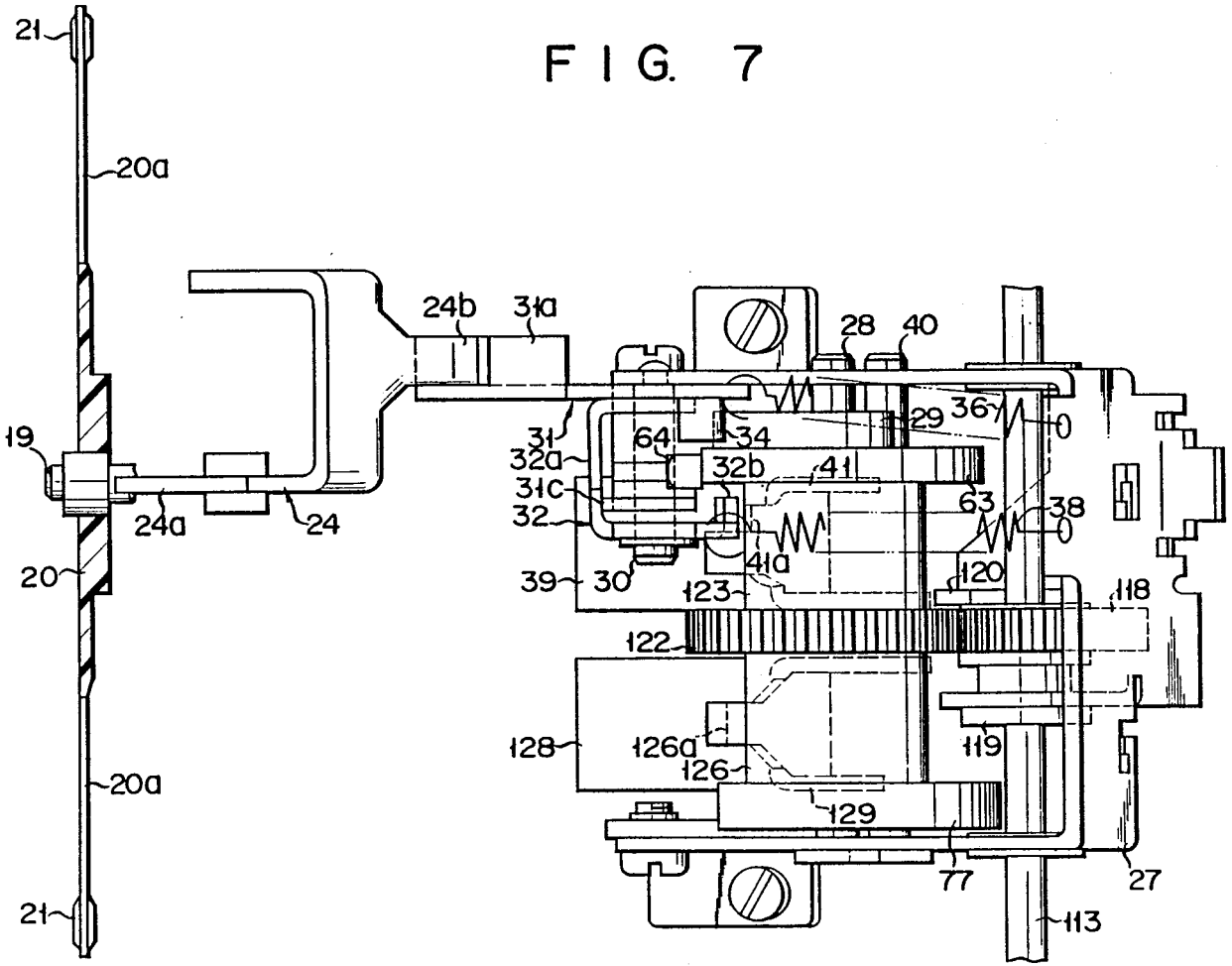
FIG. 7 is a top view corresponding to FIG. 6.

Referring now to FIGS. 4, 6 and 7, a hammer actuating mechanism 154 will be described. A printing hammer 24 is rockably supported, at its middle portion, by a hammer shaft 23 on a hammer bracket 22 which is fixed to the rear portion of the motor bracket 15. A type striking portion 24*a* is formed on the upper end of the hammer 24 facing the platen 6, while the lower end of the hammer 24 constitutes an engaging portion 24*b*. As shown in FIGS. 6, 7 and 8, a hammer actuating cam 29 is rotatably supported by a support shaft 28 on a clutch bracket 27 which is mounted on the front portion of the carriage 8. A main operating lever 31 and an auxiliary operating lever 32 are rockably supported, at their middle and proximal portions, respectively, on the clutch bracket 27 by a support shaft 30. A link portion 31*a* is formed on one arm portion of the main operating lever 31. The portion 31*a* is adapted to upwardly engage the engaging portion 24*b* of the printing hammer 24. A cam follower 34 to engage the peripheral cam surface of the hammer actuating cam 29 protrudes from the other arm portion 31*b* of the lever 31. Also, the main operating lever 31 has an engaging piece 31*c* which is formed by bending the lever 31 so that the piece 31*c* and the main body of the lever 31 are spaced in the axial direction of the shaft 30. The lever 31 is urged, by a spring 36 stretched between the lever 31 and the clutch bracket 27, to rock in a direction such that the cam follower 34 engages the hammer operating cam 29.

The auxiliary operating lever 32 is formed with an engaging portion 32*a* which can abut against the engaging piece 31*c* of the main operating lever 31. The lever 32 is continually urged, by a spring 38 stretched between the lever 32 and the clutch bracket 27, in a manner such that the engaging portion 32*a* abuts against the engaging piece 31*c* of the main operating lever 31. An electromagnet 39 is mounted on the clutch bracket 27. Also, an armature 41 is rockably supported on the clutch bracket 27 by a support shaft 40. The armature 41 is urged to rock in the clockwise direction of FIG. 6 by a spring 44 which is stretched between the armature 41 and the clutch bracket 27. When the electromagnet 39 is excited, the armature 41 is attracted to the magnet 39 to rock counterclockwise against the urging force of the spring 44. As the armature 41 rocks in this manner, a shoulder portion 41*a* formed on the armature 41 upwardly engages a projection 32*b* of the auxiliary operating lever 32. When the main operating lever 31 is rocked clockwise by the urging force of the spring 36, the auxiliary operating lever 32 is urged also to rock in the same direction by the force of the spring 38. Since the shoulder portion 41*a* engages the projection 32*b* as aforesaid, however, the lever 32 is prevented from rocking. When the hammer actuating cam 29, in this state, is rotated in the clockwise direction of FIG. 6, only the main operating lever 31 is rocked clockwise by the urging force of the spring 36, depending on the configuration of the cam 29. Accordingly, the printing hammer 24 is urged to rock by the small urging force of the spring 36 alone.

When the electromagnet 39 is deenergized, the armature 41 is located in the position shown in FIG. 6 by the urging force of the spring 44. In this position, the armature 41 is kept apart from the projection 32*b* of the auxiliary operating lever 32. When the hammer actuating cam 29, in this state, is rotated clockwise, both of the operating levers 31 and 32 are rocked together by the urging forces of their corresponding springs 36 and 38, depending on the configuration of the cam 29. Thus, the printing hammer 24 is strongly urged to rock by the heavy joint urging force of the two springs 36 and 38.

The hammer 24 is rocked counterclockwise from the nonoperative position of FIG. 6 by the main operating lever 31. As a result, the type striking portion 24*a* strikes against the rear face of a selected one of the type elements 20*a*, thereby making a print on the printing sheet P on the platen 6.

Printing Ribbon Feed Mechanism

Figure 9:
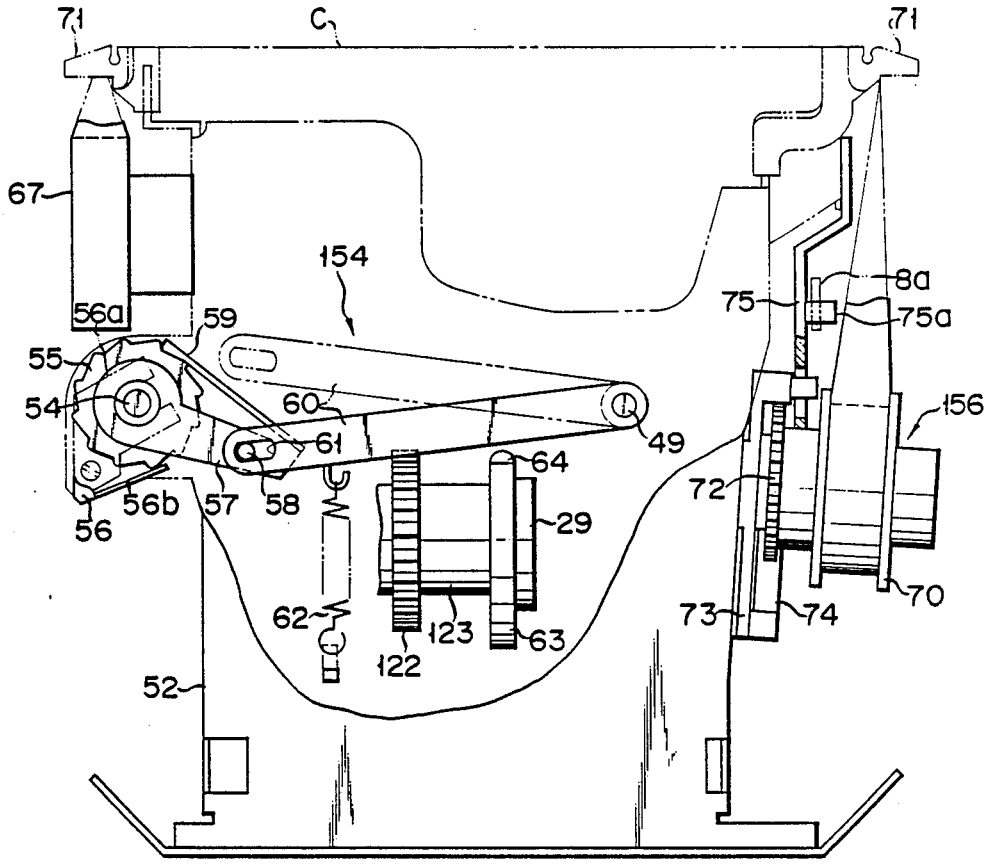
FIG. 9 is an enlarged plan view showing a printing ribbon feed mechanism and a correction ribbon feed mechanism.
Figure 10:
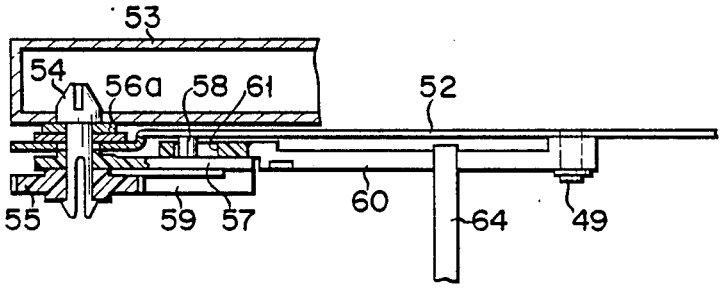
FIG. 10 is a partial sectional view showing the relationship between a ribbon cassette and the printing ribbon feed mechanism.
Figure 12:
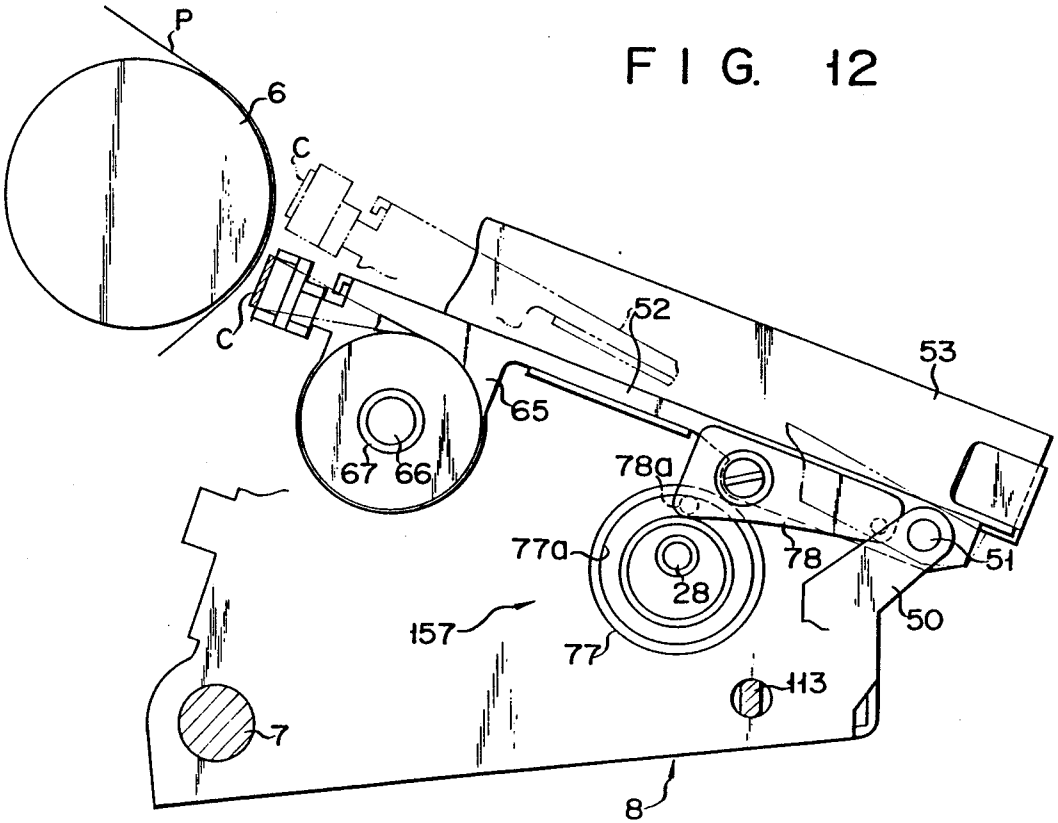
FIG. 12 is a side sectional view of a correction ribbon lift mechanism taken from the left-hand side of FIG. 2.

Referring now to FIGS. 9, 11 and 12, a printing ribbon feed mechanism 155 will be described. A cassette holder 52 is swingably supported by a support shaft 51 on a support piece 50 which protrudes from the front portion of the carriage 8. A ribbon cassette 53 is removably mounted on the top surface of the cassette holder 52. The cassette 53 is of a conventional type. A printing ribbon R contained windingly in the cassette 53 is partially exposed from the cassette 53. When the cassette holder 52 is located in a first position (rest position for correction ribbon C) indicated by full line in FIG. 12, as mentioned later, the exposed portion of the ribbon R is opposed to the printing surface of the platen 6. A feed shaft 54 is rockably supported on the holder 52 and extends into the cassette 53 so as to be coupled to a ribbon take-up spool (not shown) in the cassette 53. A ratchet wheel 55 is mounted on the lower end portion of the feed shaft 54 so as to be rotatable together with the shaft 54. A support piece 56 (FIG. 9) is fixed on the cassette holder 52. A forked portion 56*a* of the support piece 56 is adapted to engage the feed shaft 54, thus preventing the shaft 54 from coming off. As a detent 56*b* formed on the support piece 56 is brought resiliently into contact with the ratchet wheel 55 under the cassette holder 52, the wheel 55 is allowed to rotate only in the counterclockwise direction of FIG. 9.

A plastic rocking member 57 is rockably mounted, at its proximal end, on the feed shaft 54, sandwiched between the ratchet wheel 55 and the undersurface of the cassette holder 52. A pin 58 protrudes from the distal end of the rocking member 57. Further, a ratchet 59 extends integrally from the distal end of the rocking member 57 toward its proximal end portion. A free end of the ratchet 59 engages the ratchet wheel 55. A link lever 60 is rockably supported, at its proximal end, on the undersurface of the cassette holder 52 by a pivot 49. The lever 60 is formed, at its distal end, with a slot 61 in which the pin 58 is loosely fitted. The link lever 60 is continually urged to rock in the counterclockwise direction of FIG. 9 by a spring 62.

As shown in FIGS. 6 to 9, a ribbon operating cam 63 is formed integrally with and adjacent to the hammer actuating cam 29. A ribbon operating lever 64 is rockably mounted on the support shaft 30. The upper end of the lever 64 extends so as to be able to engage the link lever 60. The ribbon operating lever 64 is continually urged, by a spring (not shown) stretched between the lever 64 and the clutch bracket 27, to rock in a direction such that the lever 64 engages the ribbon operating cam 63.

Accordingly, if the ribbon operating cam 63 makes one revolution in the clockwise direction of FIG. 6 with the cassette holder 52 in the first position, the ribbon operating lever 64 swings around the shaft 30 to cover a stroke. The stroke of the lever 64 depends on the configuration of the cam 63. As it swings in this manner, the ribbon operating lever 64 engages the link lever 60. As a result, the link lever 60 swings over a stroke between a rest position indicated by the full-line in FIG. 9 and an operative position indicated by the chain line. As the link lever 60 swingingly reciprocates in this manner, the rocking member 57 is rocked for a stroke through the engagement between the slot 61 and the pin 58. Thus, the ratchet wheel 55 is rocked in the counterclockwise direction of FIG. 9 for one tooth, so that a used portion of the printing ribbon R is wound on the ribbon take-up spool in the ribbon cassette 53.

Correction Ribbon Feed Mechanism & Lift Mechanism

Referring now to FIGS. 9, 11 and 12, a correction ribbon feed mechanism 156 and a correction ribbon lift mechanism 157 will be described. The feed mechanism 156 is constructed as follows. A ribbon supply spool 67 wound with a correction ribbon C is rotatably supported by a support shaft 66 on a pendent piece 65 (FIG. 12) which is formed on the left side face (FIG. 9) of the cassette holder 52. As shown in FIG. 11, on the other hand, a take-up spool 70 is rotatably supported by a support shaft 69 on a pendent piece 68 which is formed on the right side face of the cassette holder 52. The correction ribbon C is stretched between the two spools 67 and 70. Part of the ribbon C is passed around a pair of guide pieces 71 on either side of the rear portion of the cassette holder 52, and is stretched along the platen 6 so as to underlie the printing ribbon R. As shown in FIGS. 9 and 11, a ratchet wheel 72 is rotatably mounted on the support shaft 69, held between the take-up spool 70 and the pendent piece 68. The wheel 72 is engaged by a detent (not shown) so that it can rotate only in the counterclockwise direction of FIG. 11. A plastic operating member 73 is rockably mounted, at its middle portion, on the shaft 69, and a ratchet 74 is formed integrally on the front end portion of the member 73. The ratchet 74 is adapted to engage the teeth of the ratchet wheel 72.

A support piece 8*a* protrudes integrally upward from the carriage 8. A link lever 75 is rockably supported on the support piece 8a by means of a support pin 75a which protrudes from the middle portion of the lever 75. One end of the link lever 75 is rockably coupled, by means of a pivot 79, to a coupling portion 76 formed on the cassette holder 52. The other end of the lever 75 is coupled to the rear end of the operating member 73 by means of a combination of a pin and a slot engaging each other.

The correction ribbon lift mechanism 157 is constructed as follows. As shown in FIGS. 7, 8 and 12, a lift cam 77 having an endless cam groove 77a is mounted on the support shaft 28 so as to be rotatable in the clockwise direction of FIG. 12. As shown in FIG. 12, moreover, a driven piece 78 is screwed to the left side face of the cassette holder 52. A cam follower 78a to engage the cam groove 77a protrudes from the driven piece 78. Thus, when the lift cam 77 is rotated, the cassette holder 52 swings around the support shaft 51 between the first position (rest position for correction ribbon C) indicated by the full line in FIG. 12 and a second position (operative position) indicated by the chain line, actuated by the cam follower 78a fitted in the cam groove 77a and the driven gear 78. When the cassette holder 52 is located in the first position, the printing ribbon R is opposed to a printing position on the print line of the platen 6. When the holder 52 is located in the second position, the correction ribbon C is opposed to the printing position.

As the cassette holder 52 swings in the aforesaid manner, the correction ribbon feed mechanism 156 is actuated. More specifically, the operating member 73 is alternatingly rocked by the link lever 75 shown in FIG. 11, and the ratchet wheel 72 is rocked for one tooth in the counterclockwise direction of FIG. 11 by a ratchet 74 of the operating member 73. As the take-up spool 70 rocks together with the ratchet wheel 72, the correction ribbon C is fed from left to right for one character pitch along the platen 6. Thus, the used portion of the ribbon C is wound on the take-up spool 70.

There will now be described a common drive source for supplying a driving force to the sheet feed mechanism 150, hammer actuating mechanism 154, printing ribbon feed mechanism 155, correction ribbon feed mechanism 156, and correction ribbon lift mechanism 157, and clutch means which constitute a transmission mechanism for selectively transmitting the driving force from the drive source to the foregoing mechanisms.

Clutch Means for Sheet Feed Mechanism

Figure 5:
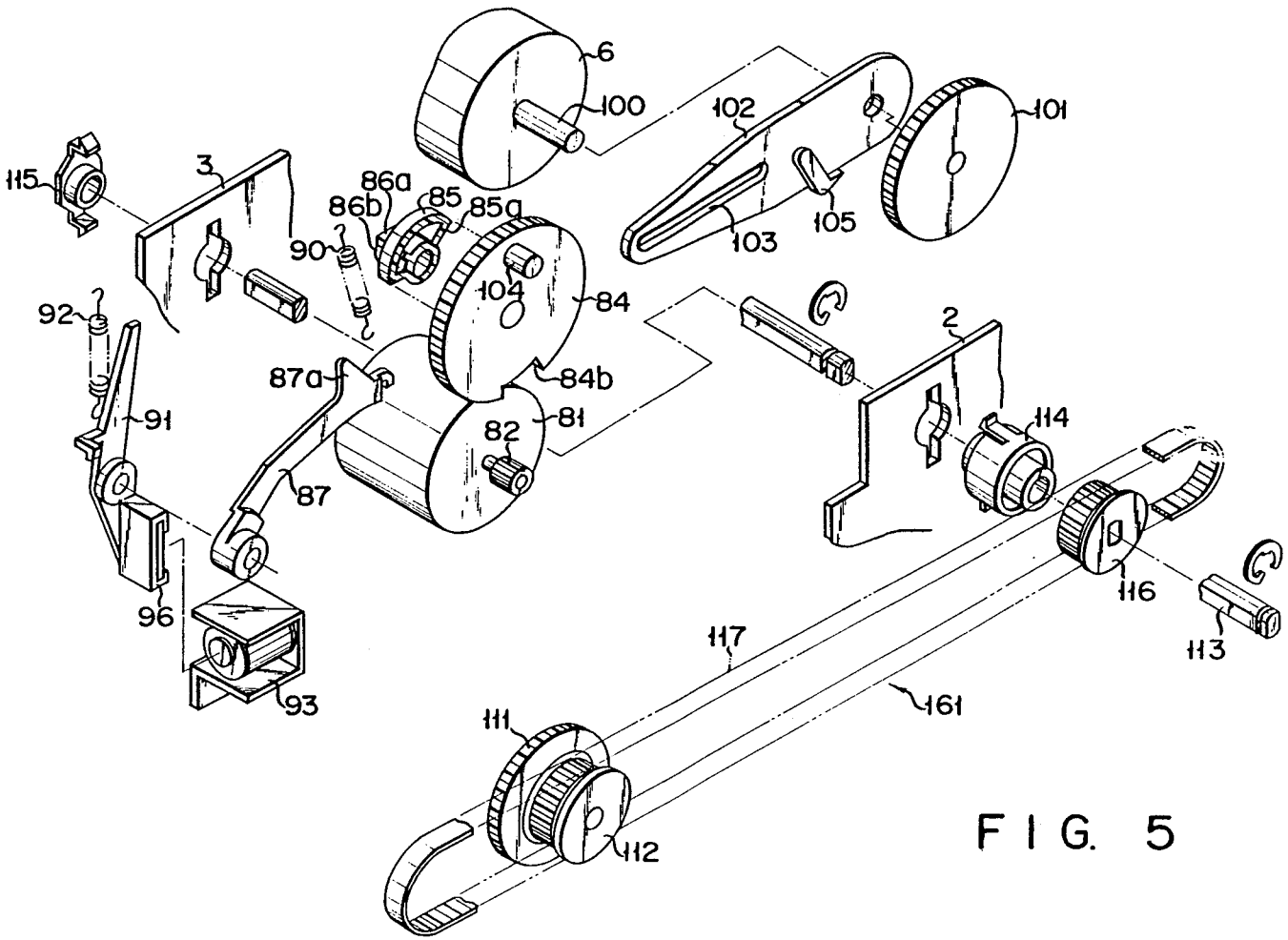
FIG. 5 is an exploded perspective view showing a sheet feed mechanism and a transmission mechanism.

Referring now to FIGS. 3 and 5, clutch means 160 for the sheet feed mechanism 150 will be described. A single drive motor 81 composed of a DC motor is mounted on a support plate 80 which is attached to the rear portion of the left side wall 2 of the frame 1. The motor 81 serves as the common drive source. A driving gear 82 is mounted on the drive shaft of the motor 81, penetrating the support plate 80 to be located outside the same. The motor 81 is supplied with DC voltage from an external power source (not shown). A driven gear 84 is rotatably mounted on the outer surface of the support plate 80 by means a stepped screw 83. The driven gear 84 is formed, on its outer periphery, with a tooth portion 84a to mesh with the driving gear 82 and a notch portion 84b incapable of engaging the gear 82. A substantially fan-shaped retaining rib 85 protrudes integrally from the inner surface of the driven gear 84. Moreover, a retaining projection 86a and a cylindrical portion 86b protrude integrally inward from the rib 85.

A first operating arm 87 is rockably supported, at its lower end portion, on the support plate 80 by a support shaft 88. Formed on the free end portion of the arm 87 is a projection 87a which is adapted to engage the engaging portion 85a of the retaining rib 85. A spring 90 is stretched between the first operating arm 87 and a spring anchor portion of the support plate 80. The driven gear 84 is continually urged to rock in the counterclockwise direction of FIG. 3 by the spring 90, aided by the engagement between the projection 87a and the engaging portion 85a of the retaining rib 85. A second operating arm 91 is rockably mounted, at its middle portion, on the support shaft 88. As the arm 91 rocks, its upper end portion can engage or leave the retaining projection 86a and the outer peripheral surface of the cylindrical portion 86b. A spring 92 is stretched between the second operating arm 91 and a spring anchor portion of the support plate 80. The arm 91 is continually urged by the spring 92 to rock in a direction such that the arm 91 engages the cylindrical portion 86b.

An electromagnet 93 is mounted on the support plate 80, facing an armature 96 provided at the lower end portion of the second operating arm 91. When the electromagnet 93 is deenergized, the upper end of the arm 91 is caused to engage the retaining projection 86a and the outer peripheral surface of the cylindrical portion 86b by the urging force of the spring 92, as shown in FIG. 3. If the electromagnet 93 is excited with the notch portion 84b of the driven gear 84 opposed to the driving gear 82, the armature 96 of the second operating arm 91 is attracted by the electromagnet 93. Thus, the arm 91 is rocked in the counterclockwise direction, so that the upper end portion of the lever 91 is disengaged from the retaining projection 86a.

Meanwhile, the driven gear 84 is slightly rocked counterclockwise by the urging force of the spring 89, assisted by the engagement of the first operating arm 87 and the retaining rib 85. As a result, the tooth portion 84a of the driven gear 84 engages the driving gear 82, so that the rotation of the driving gear 82 can be transmitted to the driven gear 84. In other words, the clutch means 160 is connected. If the driving gear 82, in this state, is rotated clockwise by the drive motor 81, the driven gear 84 is rotated counterclockwise, following the driven gear 82. When the notch portion 84b is opposed again to the driving gear 82, the clutch means 160 is released to interrupt the transmission of the rotation.

After the electromagnet 93 is excited, the retaining projection 86a and the driven gear 84 rotate as a body. When the projection 86a is disengaged from the upper end portion of the second operating arm 91, deenergization of the electromagnet 93 causes the arm 91 to rock and return to a position within the stroke of the projection 86a. When the arm 91 is opposed again to the projection 86a as the driven gear 84 is rotated, that is, the moment the notch portion 84a faces the driving gear 82, the arm 91 engages the projection 86a again to stop the rotation of the driven gear 84. While the driven gear 84 is rotating, the first operating arm 87 is swung in engagement with the outer peripheral surface of the retaining rib 85. When it faces the engaging portion 85a of the rib 85, the arm 87 engages the portion 85a again.

Referring further to FIGS. 3 and 5, the sheet feed mechanism 150 coupled to the clutch means 160 of the above-mentioned construction will be described. A ratchet wheel 101 is fixed on a left-hand rocking shaft 100 of the platen 6. Also, a rocking lever 102 is rockably mounted, at its front end portion, on the shaft 100, extending at right angles to the platen 6. A slot 103 is bored through the rear portion of the rocking lever 102, elongated in the longitudinal direction thereof. An engaging pin 104 protruding from the driven gear 84 is fitted in the slot 103. A ratchet 105 is rockably mounted, at its proximal end, on the rocking lever 102. The ratchet 105 is continually urged by a spring (not shown) to rock in a direction such that its detent portion engages the teeth of the ratchet wheel 105.

When the driven gear 84 makes a turn with the clutch means 160 connected, the rocking lever 102 is alternatingly rocked around the engaging pin 104 fitted in the slot 103. As the lever 102 rocks in this manner, the ratchet wheel 101, along with the platen 6, is rocked through a predetermined angle by the ratchet 105. Thus, the printing sheet P on the platen 6 is subjected to a feeding force and fed for one line.

Transmission Mechanism

There will now be described a transmission mechanism 161 for transmitting the driving force of the single drive motor 81 to the hammer actuating mechanism 154, printing ribbon feed mechanism 155, correction ribbon feed mechanism 156, and correction ribbon lift mechanism 157.

As shown in FIGS. 3 and 5, a transmission gear 111, which is continually in mesh with the driving gear 82, is rotatably mounted on the support plate 80 by means of a support shaft 110. Also, a toothed pulley 12 is mounted on the shaft 110 so as to be rotatable in one with the gear 111. As shown in 2, 3 and 5, an operating shaft 113 with a track-shaped cross section is rotatably supported between both side walls 2 and 3 of the frame 1 by means of a pair of bearings 114 and 115, penetrating the carriage 8 and extending parallel to the platen 6. A toothed pulley 116 is mounted on one end portion of the shaft 113 so as to be rotatable together therewith. An endless toothed belt 117 is passed around the two toothed pulleys 112 and 116. As the drive motor 81 rotates, the operating shaft 113 is rotated in the counterclockwise direction of FIG. 3 through the medium of the driving gear 82, transmission gear 111, toothed pulleys 112 and 116, and the toothed belt 117.

As shown in FIGS. 7 and 8, an intermediate gear 118 is mounted on the operating shaft 113, inside the carriage 8, by means of a bearing 119 which is attached to the clutch bracket 27. The gear 118 can rotate together with the shaft 113 and slide axially. Stoppers 120 are formed integrally on the bracket 27. Thus, the intermediate gear 118 is held by the bearing 119 and the stoppers 120 so as to be movable together with the carriage 8 along the operating shaft 113.

Clutch Means for Hammer Actuating Mechanism & Printing Ribbon Feed Mechanism

Referring now to FIG. 8, common clutch means 162 for the hammer actuating mechanism 154 and the printing ribbon feed mechanism 155 will be described. Bosses 63*a* and 77*b* having the same outside diameter protrude integrally from the ribbon operating cam 63 and the lift cam 77, respectively. Between the bosses 63*a* and 77*b*, a cylindrical rotating body 121 having the same outside diameter as the bosses 63*a* and 77*b* is rotatably mounted on the support shaft 28. A driven gear 122 to mesh with the intermediate gear 118 is formed integrally on the outer peripheral surface of the central portion of the shaft 28. A cylindrical retainer 123 is rotatably fitted on the rotating body 121 and the boss 63*a* so as to cover the outer peripheral surfaces thereof. Interposed between the retainer 123 and a combination of the rotating body 121 and the boss 63*a* is a clutch spring 124 for actuating the printing hammer 24 and feeding the printing ribbon R. One end of the clutch spring 124 is fixed to the boss 63*a*, and the other end to the retainer 123. Formed on the outer peripheral surface of the retainer 123 is a retaining portion 123*a* which can engage a hook portion at the upper end of the armature 41 shown in FIG. 6. When the retainer 123 rotates in the clockwise direction of FIG. 6, the clutch spring 124 coils around the rotating body 121 and the boss 63*a*, reducing its diameter. Thus, the rotating body 121 and the boss 63*a* are connected, that is, the clutch means 162 is connected.

If the electromagnet 39 is deenergized so that the hook portion of the armature 41 engages the retaining portion 123*a* of the retainer 123, as shown in FIG. 6, the retainer 123 is restrained from rotating clockwise. In this state, therefore, even if the rotating body 121 is rotated clockwise through the engagement between the driven gear 122 and the intermediate gear 118, the clutch spring 124 never coils around the rotating body 121 and the boss 63*a*, leaving them disconnected. In other words, the clutch means 162 is disconnected. Thus, the ribbon operating cam 63 and the hammer actuating cam 29 are held in a stop state.

On the other hand, if the electromagnet 39 is excited so that the armature 41 is located off the stroke of the retaining portion 123*a* of the retainer 123, the retainer 123 is allowed to rotate, causing the rotating body 121 and the boss 62*a* to be connected by the clutch spring 124. If the rotating body 121, in this state, is rotated in the clockwise direction of FIG. 6, therefore, its moment of rotation is transmitted to the ribbon operating cam 63 and the hammer actuating cam 29 to rotate the same. As the cams 63 and 29 rotate in this manner, the hammer actuating mechanism 154 and the printing ribbon feed mechanism 155 are actuated.

Clutch Means for Correction Ribbon Feed Mechanism & Correction Ribbon Lift Mechanism Referring now to FIG. 8, common clutch means 163 for the correction ribbon feed mechanism 156 and the correction ribbon lift mechanism 157 will be described. A retainer 126 having substantially the same shape as the retainer 123 is rotatably fitted on the rotating body 12 and the boss 77*b* so as to cover the outer peripheral surfaces thereof. A clutch spring 127 is interposed between the retainer 126 and a combination of the rotating body 121 and the boss 77*b*. One end of the clutch spring 127 is fixed to the boss 77*b*, and the other end to the retainer 126. A pair of retaining portions 126*a* are formed on the outer peripheral surface of the retainer 126, diametrically facing each other. When the retainer 126 rotates in the clockwise direction of FIG. 6, the clutch spring 127 coils around the rotating body 121 and the boss 77*b*, reducing its diameter. Thus, the rotating body 121 and the boss 77*b* are connected, that is, the clutch means 163 is connected.

As shown in FIG. 7, moreover, an electromagnet 128 is arranged side by side with the hammer actuating electromagnet 39 on the clutch bracket 27. Also, an armature 129 adapted to be attracted by the electromagnet 128 is rockably mounted on the support shaft 40 in parallel with the armature 41. Having substantially the same shape as the armature 41, the armature 129 is continually urged to rock toward the retainer 126 by a spring (not shown).

If the electromagnet 128 is deenergized so that the armature 129 engages the retaining portions 126*a* of the retainer 126, as shown in FIG. 7, the retainer 126 is restrained from rotating in the clockwise direction of FIG. 6. In this state, therefore, even if the rotating body 121 is rotated clockwise through the engagement between the driven gear 122 and the intermediate gear 118, the clutch spring 127 never coils around the rotating body 121 and the boss 77*b*, leaving them disconnected. In other words, the clutch means 163 is disconnected. Thus, the lift cam 77 is held in a stop state.

On the other hand, if the electromagnet 128 is excited so that the armature 129 is located off the stroke of the retaining portion 126*a* of the retainer 126, the retainer 126 is allowed to rotate, causing the rotating body 121 and the boss 77*b* to be connected by the clutch spring 127. If the rotating body 121, in this state, is rotated in the clockwise direction of FIG. 6, therefore, its moment of rotation is transmitted to the lift cam 77 to rotate the same. As the cam 77 rotates in this manner, the cassette holder 52 is swung, and the correction ribbon feed mechanism 156 and the correction ribbon lift mechanism 157 are actuated.

Electric Circuit Configuration

Turning now to the block diagram of FIG. 1, an electric circuit of the printer will be described. In FIG. 1, numeral 140 designates a central processing unit (hereinafter referred to as CPU), which is connected with a read-only memory (hereinafter referred to as ROM) 141 and a random access memory (hereinafter referred to as RAM) 142 stored with programs for controlling the general operation of the printer. When any of the keys K on the keyboard B are depressed, various signals, such as a printing signal, sheet feed signal, etc., are applied to the input of the CPU 140. The CPU 140 is connected, on its output side, with chopping means 143 and the electromagnets 93, 39 and 128 for sheet feed, hammer actuation, and correction ribbon lift. The chopping means 143 is connected with the single drive motor 81 through a motor driver 144, while the motor 10 for carriage drive and the motor 16 for type selection are connected to the CPU 140 through their corresponding motor drivers 146 and 145.

The drive motor 81, as a common drive source, is connected to the mechanisms 150 and 154 to 157 through the clutch means 160, 162 and 163, by means of mechanical connecting lines indicated by broken lines in FIG. 1.

Likewise, the carriage drive motor 10 and the type selection motor 16 are connected to the carriage 8 and the daisy wheel 20, respectively, by means of mechanical connecting lines.

If a sheet feed signal is applied to input of the CPU 140 by depressing a predetermined key K on the keyboard B, the CPU 140 executes a control operation such that the drive motor 81 is supplied with a chopped supply voltage via the chopping means 143 and the motor driver 144. At the same time, the CPU 140 actuates the electromagnet 93 for sheet feed.

By the chopping control, the chopped supply voltage supplied from the power source to the motor 81 is changed into a voltage lower on the average than the predetermined voltage supplied directly from the external power source. The driving force of the motor 81 is transmitted to the sheet feed mechanism 150 via the clutch means 160, thereby actuating the mechanism 150. In this case, the sheet feed mechanism 150 as a driven section has a relatively small rotational load and is required to be driven at low speed. To comply with these operating conditions of the mechanism 150, the driving force and rotating speed of the motor 81 are reduced by the aforesaid chopping control.

If printing signals are applied to the input of the CPU 140 by depressing any of the character keys K on the keyboard B, the CPU 140 controls the motor driver 144 so that the drive motor 81 is supplied directly with the unchopped supply voltage. At the same time, the CPU 140 controls the motor driver 145 to drive the type selection motor 16. Also, the electromagnet 39 is actuated.

Thus, in this case, the unchopped, predetermined supply voltage is supplied to the motor 81, so that the motor 81 rotates at high speed with a great driving force, thereby operating the hammer actuating mechanism 154 and the printing ribbon feed mechanism 155 constituting a driven section, through the medium of the clutch means 162. As compared with sheet feed mechanism 150, the mechanisms 154 and 155 require a greater rotational load and higher operating speed. To meet these requirements, the motor 81 is supplied directly with the predetermined supply voltage without having been subjected to chopping control by the chopping means 143.

Also in operating the correction ribbon feed mechanism 156 and the correction ribbon lift mechanism 157 constituting a driven section which requires a great rotational load and high operating speed, the CPU 140 performs a control operation such that the drive motor 81 is supplied directly with the unchopped supply voltage. This control operation is started when a correction signal CPU 140 is applied to the CPU 140 by depressing a correction key on the keyboard B and a character key K corresponding to a misprinted character. In this case, the motor 81 is continuously supplied with voltage through the motor driver 144 for a predetermined time. At the same time, the electromagnet 128 is actuated to move the cassette holder 52 to the lift position.

At the time of the input of the printing signals or a carriage return signal, the CPU 140 actuates the carriage drive motor 10 through the motor driver 146, thereby moving the carriage 8.

Figure 13:
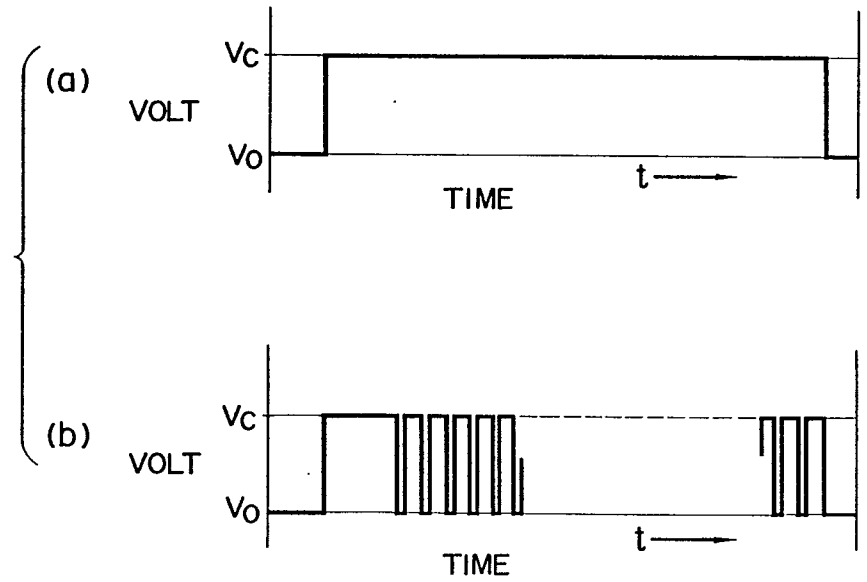
FIG. 13(*a*) is a time chart illustrating a voltage supply to a drive motor without chopping control.

FIG. 13(*a*) is a time chart illustrating the transition of the voltage supplied to the motor 81 with the passage of time t. This chart is based on the operation of the hammer actuating mechanism 154, printing ribbon feed mechanism 155, correction ribbon feed mechanism 156, or correction ribbon lift mechanism 157. Once a voltage of a predetermined value $V_C$ equal to the supply voltage is supplied to the motor 81, it is maintained till the end of an operation cycle. In this case, the chopping control is not performed.

FIG. 13(*b*) is a time chart for the operation of the sheet feed mechanism 150. In this case, the voltage equal to the supply voltage $V_C$ is continuously supplied to the motor 81 at the initial stage of the operation cycle. At this point of time, the chopping control is not started yet. After the driving force of the motor 81 is increased to attain a predetermined rotating speed, the chopping control is continuously executed until the end of the operating cycle. As a result, the mean value of the supplied voltage is lowered to make the driving force and rotating speed suited for the sheet feed mechanism 150.

The chopping means 143 may be formed of a conventional chopper circuit.

Operation

The operation of the printer with the above-mentioned construction will now be described.

If any of the character keys K on the keyboard B are depressed, with the carriage 8 located in its printing position corresponding to the platen 6 and with the printing hammer 24 in the rest position, then the drive motor 81 is continuously supplied with the predetermined supply voltage without the operation of the chopping means 143 shown in FIG. 1. When the electromagnet 39 shown in FIG. 6 is continuously excited for a predetermined time for printing under a predetermined printing pressure, the armature 41 is rocked by attraction and held in an attracted position. When the shoulder portion 41*a* of the armature 41 engages the projection 32*b* of the auxiliary operating lever 32, the lever 32 is held in the position shown in FIG. 6. Thus, the urging force of the spring 38 is canceled during the printing operation mentioned later.

As the armature 41 is rocked in the aforesaid manner, moreover, it is disengaged from the retaining portion 123*a* of the retainer 123. Thus, the clutch means is connected, and the rotating body 121 is coupled to the boss 63*a* of the ribbon operating cam 63. As a result, the driving force of the drive motor 81 is transmitted to the operating shaft 113 through the transmission mechanism 161, so that the intermediate gear 118 is rotated together with the operating shaft 113.

The rotation of the intermediate gear 118 is transmitted to the ribbon operating cam 63 and the hammer actuating cam 29 via the driven gear 122, the clutch spring 124, etc., so that the cams 63 and 29 are rotated as a body.

While the ribbon operating cam 63 makes one revolution, the ribbon operating lever 64, the linking lever 60, and the ratchet 59 are actuated in association with one another. As the ratchet 59 is operated in this way, the ratchet wheel 55 is rocket for one tooth. Thus, the used portion of the printing ribbon R is drawn back into the ribbon cassette 53, while the unused portion is paid out from the cassette 53.

As the type selection motor 16 rotates, the type element 20*a* corresponding to the depressed character key K is selectively opposed to the printing surface of the platen 6. While the hammer actuating cam 29 makes one revolution, the main operating lever 31 rocks through a predetermined angle, guided by the cam follower 34 following the cam 29. As the lever 31 rocks in this manner, the type 21 on the type element 20*a* is struck on the back by the printing hammer 24. Thus, a character represented by the type 21 is printed on the printing sheet P.

After the printing operation is accomplished, the main operating lever 31 is rocked against the urging force of the spring 36. In the meantime, the engaging piece 31*c* of the lever 31 abuts against the engaging portion 32*a* of the auxiliary operating lever 32, so that the two operating levers 31 and 32 are rocked together in the same direction. As a result, the projection 32*b* of the auxiliary operating lever 32 is disengaged from the shoulder portion 41*a* of the armature 41.

Thereafter, the electromagnet 39 is deenergized, and the armature 41 is returned to the position within the stroke of the retaining portion 123*a* of the retainer 123. Therefore, when the retaining portion 123*a* engages the armature 41 as the retainer 123 is rotated continuously, the cams 63 and 29 are disengaged from the rotating body 122, that is, the clutch means is disconnected. At this point of time, the operating cycle for one character is completed.

In correcting the misprinted character, the correction key and then the character key K corresponding to the misprinted character are depressed after the carriage 8 is returned to the site of misprinting. As a result, the predetermined supply voltage is supplied continuously to the drive motor without actuating the chopping means 143, as in the foregoing case. Then, the electromagnets 39 and 128 are excited instantaneously. When the electromagnet 128 is excited for a moment, the armature 129 is rocked by attraction. The rotating body 121 is coupled to the boss 77*b* of the lift cam 77, that is, the clutch means is connected, until the armature 129 engages one of the retaining portions 126*a* of the retainer 126 after it is separated from the other retaining portion 126*a* which is diametrically opposed to the one retaining portion 126*a*. Accordingly, the driving force of the drive motor 81 is transmitted to the operating shaft 113 through the transmission mechanism 161, and the intermediate gear 118 is rotated together with the shaft 113.

The rotation of the intermediate gear 118 is transmitted to the lift cam 77 via the driven gear 122, the clutch spring 127, etc., so that the cam 77 is rotated for a half turn. While the cam 77 makes a half turn, the cassette holder 52 is lifted from the first position to the second position, guided by the cam follower 78*a*. As the cassette holder 52 is lifted in this manner, the operating member 73 is rocked forward through the medium of the linking lever 75, so that the ratchet 74 is rocked for one tooth.

As the electromagnet 39 is excited, the rotation of the operating shaft 113 is transmitted to the cams 29 and 63. While the cassette holder 52 is located in the second position, the printing hammer 24 performs a printing action to erase the misprint by means of the correction ribbon C.

Thereafter, the electromagnet 128 is excited again for a moment, so that the driven gear 122 and the lift cam 77 are coupled together to connect the clutch means, and the cam 77 is rotated for another half turn. As a result, the cassette holder 52 is swung down from the second position to the first position. Also, the operating member 73 is rocked in the returning direction to cause the ratchet 74 to rock for another tooth. Accordingly, the used portion of the correction ribbon C is drawn back into the cassette holder 52, while the unused portion is paid out.

As the cassette holder 52 is lifted in the aforesaid manner, the linking lever 60 moves upwardly away from the stroke of the operating lever 64, thus preventing the printing ribbon R from being fed. According to this embodiment, the carriage 8 need not carry thereon the motor for hammer actuation or correction ribbon lift, so that it may be reduced in size and in manufacturing cost. Also, the carriage 8 may be reduced in weight to lighten the load motor 10 for carriage drive. Thus, the carriage 8 can be moved smoothly.

In applying a feeding force to the sheet P, a carriage return key (not shown) on the keyboard B is depressed after printing characters for one line, for example. Thereupon, the chopping means 143 is actuated, so that a chopped supply voltage is supplied to the drive motor 81, rotating the motor 81 intermittently for a predetermined time. At the same time, the electromagnet 93 is excited instantaneously, causing the second operating arm 91 to be rocked by attraction and disengaged from the retaining projection 86*a* of the cylindrical portion 86. Accordingly, the driven gear 84 is rocked slightly by the urging force of the spring 90, assisted by the engagement between the projection 87*a* of the first operating arm 87 and the retaining rib 85. Thus, the notch portion 84*b* of the driven gear 84 is disengaged from the driving gear 82, while the tooth portion 84*a* engages the gear 82.

The rotation of the driving gear 82 is transmitted to the driven gear 84. While the driven gear 84 makes a turn, the rocking lever 102 is alternatingly rocked, assisted by the engagement between the engaging pin 104 and the slot 103. Thereupon, the ratchet 105 causes the ratchet wheel 101 to rock through a predetermined angle. Thus, the platen 6, which is adapted to rock along with the wheel 101, feeds the printing sheet P.

When the driven gear 84 makes a turn so that the notch portion 84*b* faces the driven gear 82 again, the transmission of the driving force is interrupted. At this time, the electromagnet 93 is deenergized, so that the second operating arm 91 is caused to engage the retaining projection 86*a* by the urging force of the spring 92. Also, the projection 87*a* of the first operating arm 87 engages the engaging portion 85*a* of the retaining rib 85, and the driven gear 84 stops at the position shown in FIG. 3.

Although the printer according to the above described embodiment of the present invention is of a daisy-wheel type, the invention may also be applied to printers with a printing head of a dot-impact or thermal-transfer type, or typewriters with a single, wheel-shaped or cylindrical character head. Moreover, a printer having a thermal head may, for example, be constructed so that a common motor is used to drive, along with the sheet feed mechanism and ribbon feed mechanism, a mechanism for shifting the head between a printing position close to a thermal printing sheet and a release position remote from the sheet.

The spirit and scope of the invention should not be limited to any obvious changes or modifications which would occur to those skilled in the art. The invention should be interpreted with respect to the following appended claims.

What is claimed is:

1. A printer which has a printing hammer, a printing ribbon interposed between the printing hammer and a printing medium, a printing medium feed mechanism including a platen movable with the printing medium thereon, and a printing section including a printing ribbon feed mechanism for feeding the printing ribbon and a hammer actuating mechanism for actuating the printing hammer, said printer comprising:

a single DC motor supplied with a predetermined supply voltage;

transmission means for selectively connecting the motor to the printing medium feed mechanism and the printing section, said transmission means including electromagnetic means operative selectively to transmit the driving force of the motor to the printing section and the printing medium feed mechanism, whereby said printing section and the printing medium feed mechanism are operated respectively;

chopping means operative chop the predetermined supply voltage so as to reduce the driving force and rotating speed of the motor;

signal generating means for generating a printing signal commanding the operation of the printing section and a feed signal commanding the operation of the printing medium feed mechanism; and control means responsive to the signals generated by the signal generating means for controlling the chopping means and the electromagnetic means, said control means rendering the printing section through the electromagnetic means operative and the chopping means and the printing medium feed mechanism inoperative when the signal generating means generates the printing signal, and rendering the chopping means and the printing medium fee mechanism through the eletromagnetic means operative and the printing section inoperative when the signal generating means generates the feed signal.

2. A printer which has a printing hammer, a printing ribbon interposed between the printing hammer and a printing medium, a printing medium feed mechanism including a platen movable with the printing medium thereon, and a printing section including a printing ribbon feed mechanism for feeding the printing ribbon and a hammer actuating mechanism for actuating the printing hammer, said printer comprising:

a single DC motor supplied with a predetermined supply voltage;

transmission means for selectively connecting the motor to the printing medium feed mechanism and the printing section, said transmission means including first electromagnetic means operative to transmit the driving force of the motor to the printing section and second electromagnetic means operative to transmit the driving force of the motor to the printing medium feed mechanism;

chopping means operative to chop the predetermined supply voltage so as to reduce the driving force and rotating speed of the motor;

signal generating means for generating a printing signal commanding the operation of the printing section and a feed signal commanding the operation of the printing medium feed mechanism; and control means responsive to the signals generated by the signal generating means for controlling the chopping means and the first and second electromagnetic means, said control means rendering the first electromagnetic means operative and the chopping means and the second electromagnetic means inoperative when the signal generating means generates the printing signal, and rendering the chopping means and the second electromagnetic means operative and the first electromagnetic means inoperative when the signal generating means generates the feed signal.

3. The printer according to claim 2, wherein said printer further comprises a correction ribbon located in a printing position between the printing medium and the printing hammer, and said printing section includes a correction ribbon feed mechanism for feeding the correction ribbon and a correction ribbon lift mechanism for lifting the correction ribbon from a rest position to the printing position.

4. The printer according to the claim 2, wherein said printing hammer is provided on a carriage movable along and relatively to the platen, said printing section is provided on the carriage, said DC motor is supported on a frame of the printer, and said transmission means includes an operating shaft extending parallel to the platen and rotatably supported on the frame so as to be operatively connected to the printing section, and pulley-belt transmission means for operatively connecting the operating shaft and the DC motor.

5. The printer according to claim 2, wherein said transmission means further includes an operating shaft extending parallel to the platen and rotatably supported on a frame of the printer, an intermediate member rotatable with the operating shaft and axially slidable with a carriage supporting the printing hammer along the operating shaft, and common clutch means cooperating with the first electromagnetic means for operatively connecting the intermediate member with plural cams which are adapted to actuate the printing section.

* * * * *

UNITED STATES PATENT AND TRADEMARK OFFICE

CERTIFICATE OF CORRECTION

PATENT NO. : 4,746,236

DATED : May 24, 1988

INVENTOR(S) : JUNJI SHIODA

It is certified that error appears in the above-identified patent and that said Letters Patent is hereby corrected as shown below:

IN THE CLAIM:

Claim 1, column 16, line 1, between "operative" and "chop" insert --to--.

Signed and Sealed this

Eighth Day of November, 1988

*Attest:*

DONALD J. QUIGG

*Attesting Officer*

*Commissioner of Patents and Trademarks*